US007147225B2

(12) United States Patent
Navarro

(10) Patent No.: US 7,147,225 B2
(45) Date of Patent: Dec. 12, 2006

(54) BOARD GAME

(76) Inventor: Fausto E. Navarro, 17774 Alder St., Hesperia, CA (US) 92345

( * ) Notice: Subject to any disclaimer, the term of this patent is extended or adjusted under 35 U.S.C. 154(b) by 247 days.

(21) Appl. No.: 10/847,737

(22) Filed: May 17, 2004

(65) Prior Publication Data

US 2005/0253330 A1 Nov. 17, 2005

(51) Int. Cl.
*A63F 7/06* (2006.01)

(52) U.S. Cl. ..... 273/242; 273/108.1; 273/108.5; 273/239

(58) Field of Classification Search ..... 273/108.1, 273/108.5, 108.41, 239, 247, 242, 277, 288, 273/289, 290, 282.1, 259
See application file for complete search history.

(56) References Cited

U.S. PATENT DOCUMENTS

| | | | | | |
|---|---|---|---|---|---|
| 2,330,951 | A | * | 10/1943 | Burmester et al. | 273/247 |
| 2,528,938 | A | * | 11/1950 | Wolf | 273/108.4 |
| 3,091,459 | A | * | 5/1963 | Lindman | 273/108.4 |
| 4,257,599 | A | | 3/1981 | Cutri | |
| 4,274,635 | A | | 6/1981 | Pakogian | |
| 4,765,622 | A | * | 8/1988 | Rienzo | 273/108.5 |
| 4,872,679 | A | * | 10/1989 | Bohaski et al. | 273/317.5 |
| 5,074,556 | A | * | 12/1991 | Loeppky et al. | 273/108.5 |
| 5,092,595 | A | | 3/1992 | Daravina | |
| 5,110,127 | A | * | 5/1992 | Potter | 273/317.3 |
| 5,224,710 | A | | 7/1993 | Feokhari | |
| 5,242,164 | A | | 9/1993 | Nicoll | |
| 5,332,215 | A | * | 7/1994 | Gonzales | 273/317.5 |
| 5,423,537 | A | | 6/1995 | Santana | |
| 5,431,397 | A | | 7/1995 | Eckel et al. | |
| 5,451,050 | A | * | 9/1995 | Charles | 273/317.5 |
| 5,556,094 | A | * | 9/1996 | Shiledar Baxi | 273/108.5 |
| 5,662,326 | A | * | 9/1997 | Gebran | 273/239 |
| 5,853,172 | A | | 12/1998 | Yetken | |
| 5,906,370 | A | | 5/1999 | Poisson | |
| 6,450,497 | B1 | | 9/2002 | Bialler et al. | |
| 6,561,511 | B1 | * | 5/2003 | Vaysberg et al. | 273/108.56 |
| 6,659,457 | B1 | * | 12/2003 | Cheng | 273/108.53 |
| 6,688,596 | B1 | | 2/2004 | Nielson | |
| 6,715,758 | B1 | | 4/2004 | Shinderman | |

* cited by examiner

*Primary Examiner*—Nini F. Legesse
(74) *Attorney, Agent, or Firm*—MacPherson Kwok Chen & Heid LLP; Tom Chen

(57) ABSTRACT

A genuine fully bordered portable polymer enclosure game board, provided with non secured, multiple polymer human imaged soccer figurines, to be disposed in a random pattern determined by the player and allowing for directed movement, inserted with a micro magnetic element, to be applied on a light weight felt fabric, with printed regulation boundaries, underlain with a fine metallic screened mesh, supplied with a minute medium weight glass or polymer sphere, with altered neutral zone pockets, displayed with transparent walled and/or ramped barriers, establishing a newly developed method of play for miniaturized futbol soccer, that implements defensive and offensive formations, risks and opportunity, in a freestyle non controlled environment.

18 Claims, 9 Drawing Sheets

BOARD GAME

BACKGROUND

1. Technical Field

This invention relates to a board game, more specifically, it pertains to a board game designed to simulate the full sized game of futbol soccer.

2. Relevant Art

The game of futbol, also known as soccer, is played and enjoyed by millions of people throughout the world. However, there are many people who, for one reason or another, may be unable to play the game of soccer. For these people and others who would like to derive some of the excitement of a soccer game without playing an actual game, game board versions of soccer have been developed.

In many existing board games stationary obstructions are spaced about the board game in such a manner as to impede the travel of a simulated soccer ball. Typically, the stationary obstructions are disposed in fixed positions, having a predetermined pattern, which cannot be altered during play or even between games. Thus, the generally mobile game of soccer is not adequately simulated.

As such, it may be appreciated that there continues to be a need for a new and improved game board that more adequately simulates the play of an actual soccer game, and which allows for the variable positioning and re-positioning of impediments to a simulated soccer ball used in the play of the game.

SUMMARY

The present invention provides a game structure, which allows for player initiated placement of partially secured figurines, player initiated motion of a projectile used to simulate a soccer ball, and player initiated movement of the figurines during play, to more readily simulate the live function of the ever shifting and constantly mobile soccer game.

In one aspect of the present invention, a board is provided for simulation of the game of futbol soccer. The board includes, in combination, a game board having a planar surface with vertically raised walls and two holes targeted at the center of the shorter edges which define a goal opening such that the goals face each other at opposing ends of the game board. The shorter edges also include at least four smaller holes which define additional targets. The game board is covered with a cover, which may be made of a ferromagnetic material, or which may overlay a metallic mesh. The combination of features also includes a plurality of biasing elevation ramps having magnets embedded therein to temporarily secure the biasing elevation ramps upon the surface of the cover via an attraction to the ferromagnetic material or the underlying metallic mesh. The biasing elevation ramps retain mobility during play. The combination also includes a plurality of figurines, mounted upon a base having magnets to temporarily secure the figurines in a standing position to the game board while retaining mobility during play.

In another aspect of the invention, a soccer game apparatus is provided which includes, in combination, a planar support surface. The planar support surface includes a playing field. The playing field has a perimeter wall member fixedly and orthogonally mounted to the planar support surface in alignment with an outer perimeter of the playing field. A plurality of figurines having a human image and including a magnet are positionable on the top surface of the playing field in various patterns about the field of play. The figurines are moveable from a first position to a second position during play from having contact with a game sphere.

In one aspect of the invention, barriers having a parabolic to a semicircular shape can be used to alter the shape of the edges of the field by altering the shape of the perimeter walls, which allows for additional trajectory elevation of a game ball during play. The barriers can be coupled to the side walls using an overlapping connector.

The soccer game of the present invention substantially deviates from conventional concepts of prior methodologies. The game provides an engaging means of participation unlike other game boards. For example, the game provides for creative variety, simplicity, technique, risk, opportunity, fouls and penalties that are present in a real life, action filled soccer game.

The game board is designed and tested to resist a low to medium force impact, and to resist exterior water damage because it is enclosed in a polymer based carrying case. The portability of the game allows it to be played on any flat or semi flat surface, in unlimited locations.

The playing field can be made of a fabric, such as felt, to smooth and stabilize the direct or indirect trajectory of a projectile, such as the futbol soccer sphere. The felt is fully underlined with a fine metallic screen mesh which allows for a light magnetic attraction between the magnets disposed in the human like figurines and bias ramps and the field of play. Since the figurines and ramps are not placed in fixed positions, such as in holes, a variance of movement is allowed. For example, when a soccer ball sphere is projected manually by the contestants it may impact the base of a figurine, or else a ramp. Because of the impact, the figurine or ramp may move, which allows the game dynamics to evolve. This allows the imagination of the player to feel the challenges created by the movements, and their efforts as in a real soccer game.

The realistic simulation of the world's most popular sport is primarily designed to create smiles, thrills, challenges and total enjoyment for all the children of the world, especially for the physically or mentally impaired, handicapped and or underprivileged.

The present invention includes player figurines, goalkeeper figurines, a referee figurine, and a miniaturized simulated soccer ball. The player controls the action of the game. The present invention is designed to be portable with the ability to be used in almost every situation which would attract an affinity to the play of the game.

To start the game the miniaturized soccer ball is placed at the center of the playing surface and "flicked" by a player, determined by a coin toss. After the first kick (i.e. flick) has been taken, subsequent play proceeds alternately between players until one player scores. Upon scoring, the player who is scored upon places the ball at the center of the game board and takes the first kick starting the next round of play. The first player to score a previously agreed upon number of points is declared the winner and the game is over.

A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
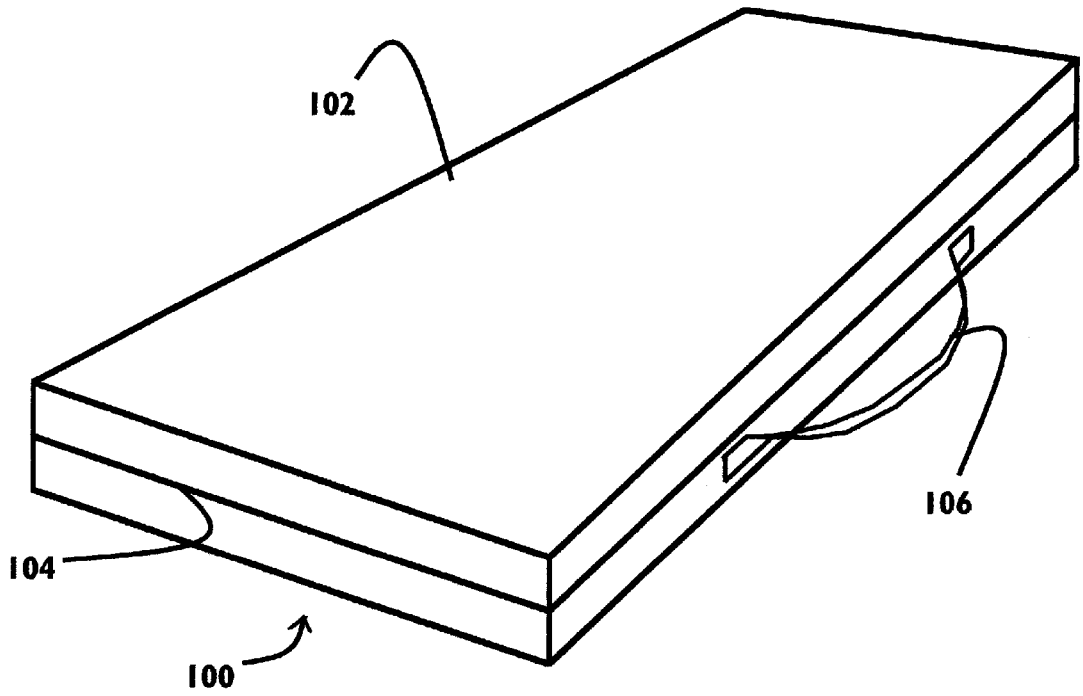
FIG. 1 is a simplified perspective view of a game board enclosure in accordance with an embodiment of the present invention.

FIG. 1 is a simplified illustration of a portable enclosure 100. In one embodiment, portable enclosure 100 includes a cover 102 and a base 104, which when assembled together create a sealed portable carrying case that is configured to contain all of the featured objects and literature associated with embodiments of the present invention.

Portable enclosure 100 can be made in a variety of shapes, sizes, colors and flexible densities. In one embodiment, portable enclosure 100 is made of a lightweight mold injected high density polymer. As such, portable enclosure 100 can be made resistant to any form of oxidation and/or saturation of hydro elements, safety tested to resist low to medium force impact, and beveled upon all edge surfaces and designed for safety. Alternatively, enclosure 100 may be made of cardboard and other similar low cost types of material.

Portable enclosure 100 may include a textured finished surface to provide a non-slip, easy gripping surface. Optionally, a handle 106 can be attached to enclosure 100 for ease of transportability.

In one embodiment, portable enclosure 100 is configured such that components, such as the non-movable goal posts and netting described below, are formed as part of base 104 of enclosure 100.

Figure 2A:
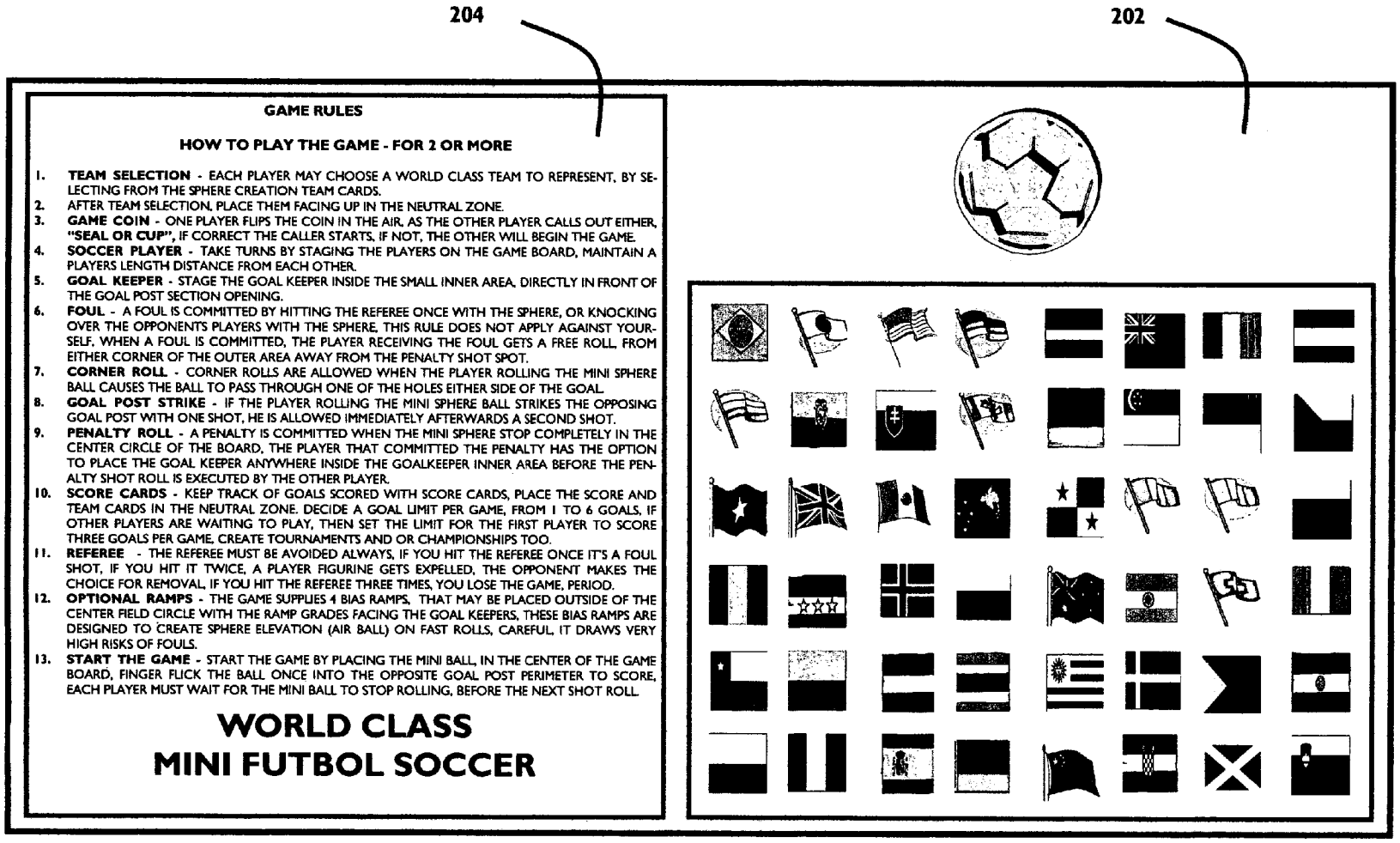
FIG. 2A is a plan view of the inner side of the top cover enclosure, in its separate opened state, with an illustration of the game rules and multi nation flags in accordance with an embodiment of the present invention.

FIG. 2A is a plan view of the inner side 202 of cover 102, in its separate opened state. Inner side 202 can include illustrations and labels. For example, an illustration of the labeled game rules 204 can be printed on inner side 202. Optionally, the specific detailed game rules can be placed on inner side 202 as an adhesive label. Inner side 202 may also include soccer team related emblems and flags as well as multi-nation flags.

Figure 2B:
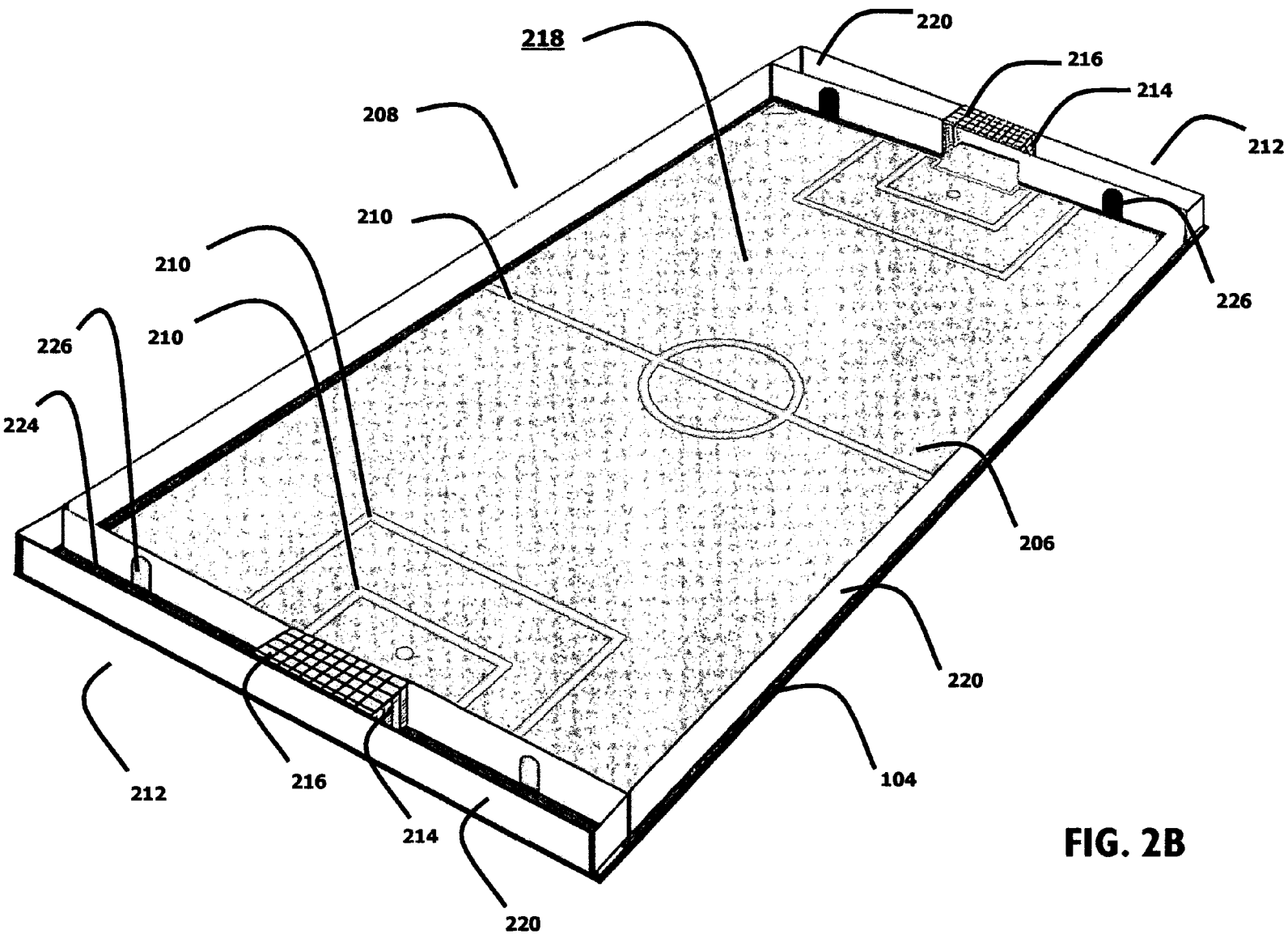
FIG. 2B is a plan view of a game board in accordance with an embodiment of the present invention.

FIG. 2B is a simplified plan view of inner side 206 of base 104 including a game board 208. In one embodiment, game board 208 is formed as part of base 104. Alternatively, game board 208 can be a stand-alone board which merely rests within the confines of base 104 when being stored.

Game board 208 has upwardly extending side walls 220 on its long and short edges, which create a fence-like boundary about game board 208.

Insets 222 are positioned parallel to side walls 220 along the short edges of game board 208. Side walls 220 and insets 222 form an open space 224 on either side of goals 212. The open space is approximately 1⅝ inches wide or approximately the width of goals 212. Insets 222 include small openings 226 to accommodate the passage of a projectile into open space 224. The passage of the projectile through one of the openings 226 results in a corner kick for the player who last struck the projectile.

In one embodiment, any open space on side walls 220 and insets 222 can be designated for the trademark logos or names of sponsoring corporate firms that may select the marketing option of placing their marks or names thereon.

The opening of goals 212 are formed and positioned on insets 222 equidistant from each long edge wall 220 of game board 208. Goals 212 provide an opening on insets 222 to facilitate the passage of the projectile into fixed goal net 216.

Although game board 208 can be made of virtually any dimensions, in one embodiment, game board 208 is approximately 21 inches by 16 inches.

Figure 3A:
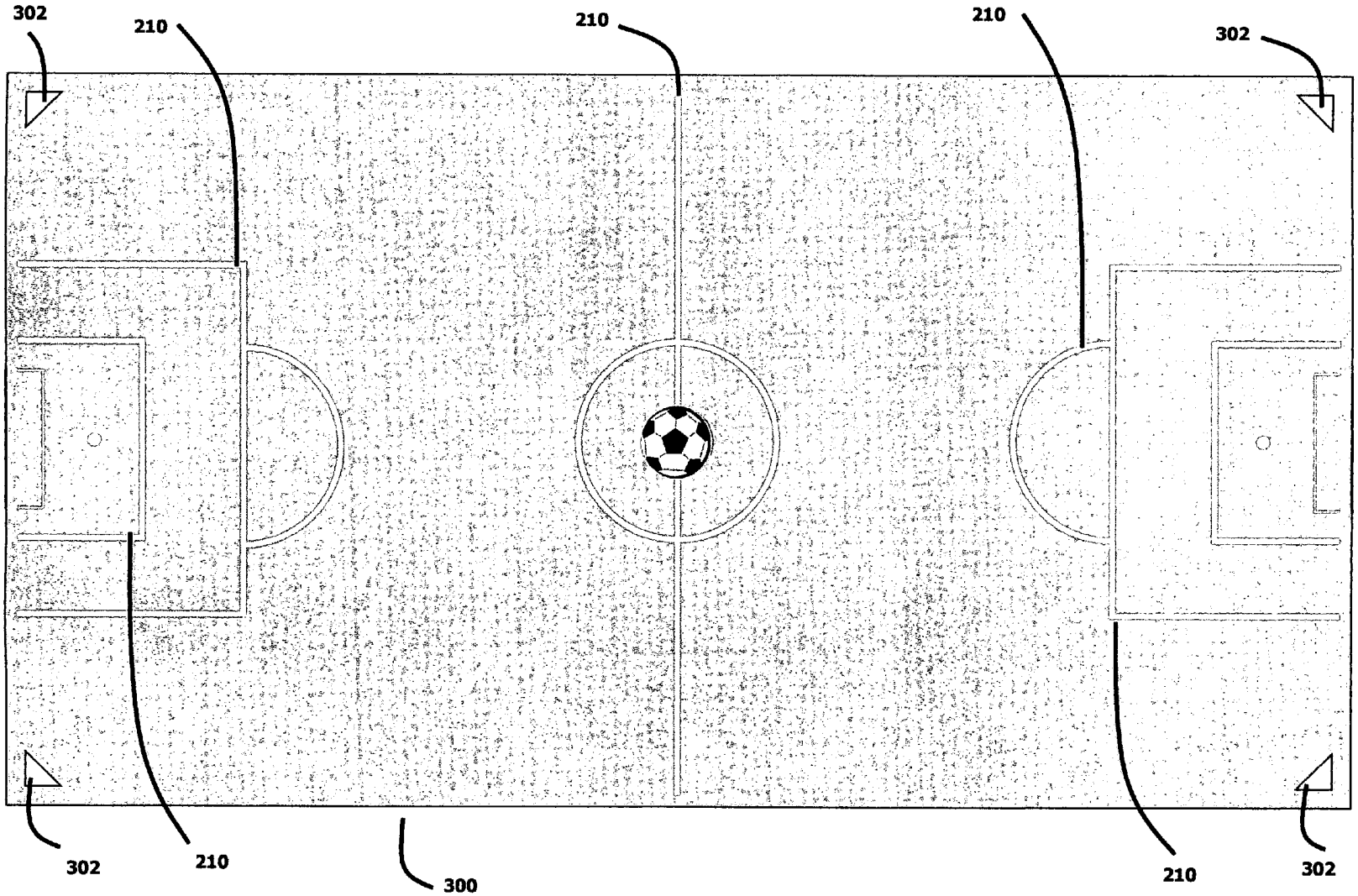
FIG. 3A is a plan view of the regulation boundary patterned cover in accordance with an embodiment of the present invention.

Game board 208 has a generally planar upper surface. As shown in FIG. 3A, a field cloth 300, such as a felt cloth and the like, is placed on game board 208. Field cloth 300 can be illustrated with markings 210 (FIG. 2B), which are regulation boundaries typically found on a soccer field and which may be laid out generally proportional to the regulation boundaries found on an actual soccer field.

In one embodiment, field cloth 300 is magnetized. The magnetized field cloth 300 allows magnetic structures, described in more detail below, to be disposed at various positions on field cloth 300.

Figure 3B:
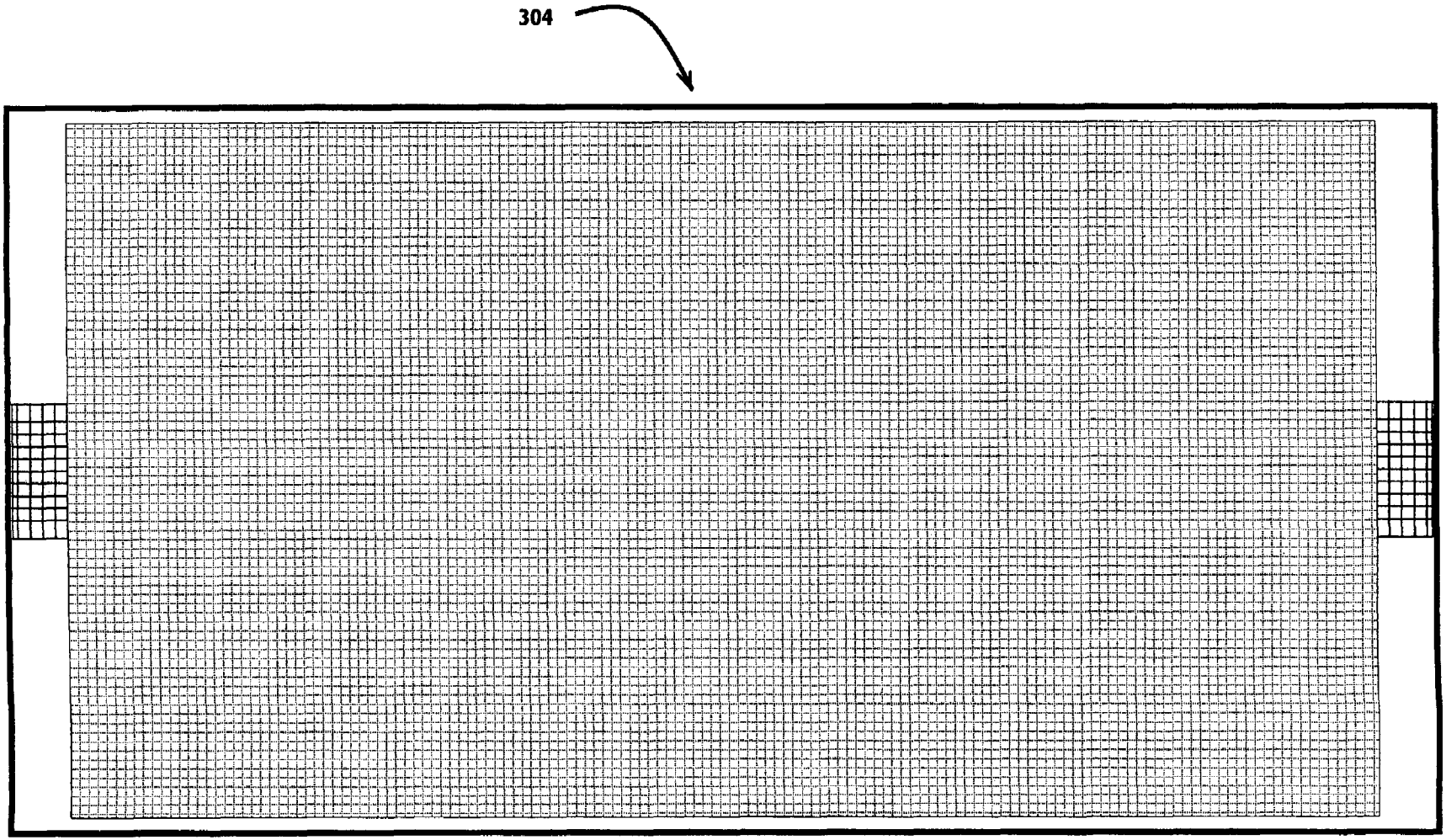
FIG. 3B is a plan view of a screen mesh in accordance with an embodiment of the present invention.

In one embodiment, a metallic mesh 304 can be placed and adhered to the raw surface of game board 208 between the planar surface of game board 208 and field cloth 300. Metallic mesh 304 (FIG. 3B) is made to underlay field cloth 300 to induce a magnetic attraction between metallic mesh 304 and various magnetic structures. Metallic mesh 304 can be a fine screen mesh that is a lightweight bendable substrate.

In one embodiment, the printed boundary felt fabric field cloth 300 is adhered to the surface of metallic mesh 304 to provide an absorbing dense surface that helps maintain a direct and indirect linear path for the trajectory of the projected soccer sphere. Additionally, during play, the texture of field cloth 300 reduces the speed of the projectile, to a complete stop, preventing the projectile from obtaining a non-linear motion differing from its intended trajectory, due to slight imbalance, or tilted foundation settings, supporting game board 208. Field cloth 300 can be any color; however, green fabric provides a color similar in appearance to that of a real turf playing field.

In one embodiment, regulation boundaries 210 can be applied to field cloth 300 by a silk screen method, where the neutral and colored inks are set and absorbed permanently into the cloth.

Referring again to FIG. 2B, game board 208 includes goals 212 having goal posts 214 and nets 216 located at opposing ends of the playing field 218. In one embodiment, game board 208 and goals 212 are one solid molded structure, which prevents damage and or loss owing to separation of its structure.

Figure 4A:
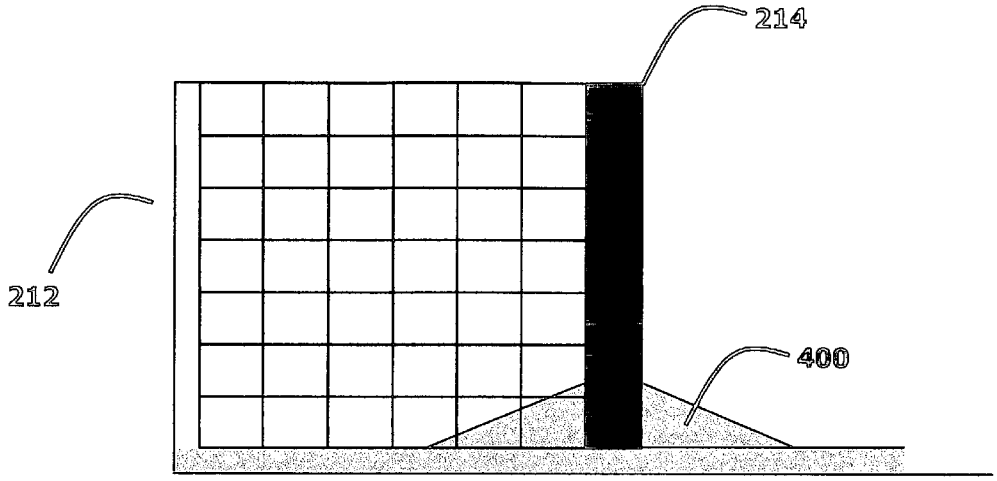
FIG. 4A a side view of netted goal posts, illustrating the goal lip bias elevation ramp in accordance with an embodiment of the present invention.

FIG. 4A is a simplified side view of goal 212, which shows a goal lip bias elevation ramp 400, which is positioned along the front opening of goal 212 between posts 214. Bias elevation ramp 400 on the lip of goal 212 ensures a level of difficulty for the projectile both entering and exiting goal 212.

Figure 4B:
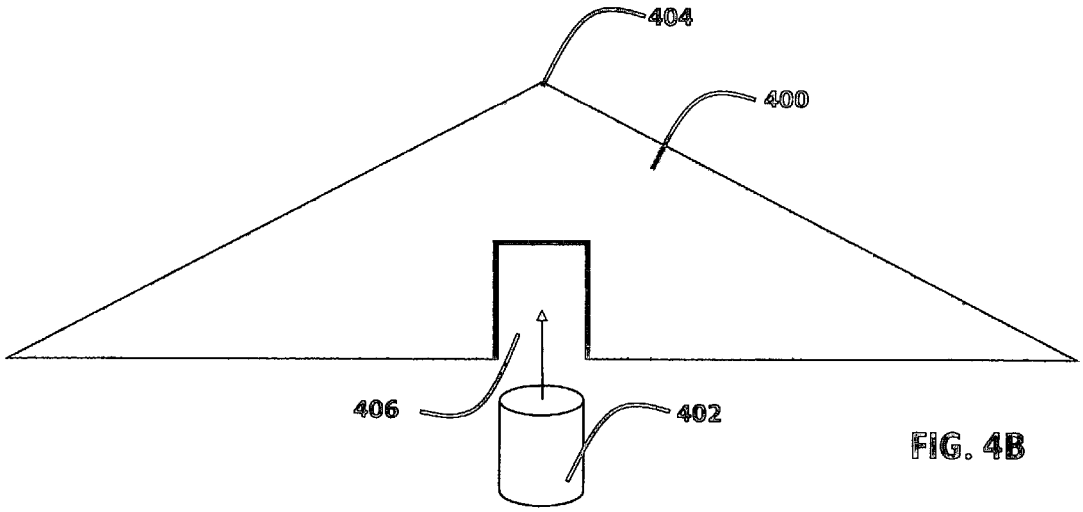
FIG. 4B is a bias elevation ramp in accordance with an embodiment of the present invention.

As shown in FIG. 4B, bias elevation ramp 400 has a generally triangular cross section. The apex 404 of bias elevation ramp 400 sits approximately along the goal line at the opening of goal 212. In this embodiment, as the projectile, such as the simulated soccer ball described in more detail below, enters goal 212 it may be blocked from entering if the projectile is not delivered with enough force to overcome the bias elevation ramps pitch. The projectile can also become elevated which can add a sense of realism to the game. Once the projectile is in the goal, bias elevation ramp 400 helps to keep the projectile from moving out of the goal.

Placement of bias elevation ramp 400 on the lip of goal 212 is optional. Thus, as shown in FIG. 4B, a magnet 402 is positioned within a hole 406 defined on bias elevation ramp 400. Magnet 402 is attracted to the magnetized field cloth 300 (or the metallic mesh 304) to temporarily secure bias elevation ramp 400 to playing field 218, when desired. In one embodiment, bias elevation ramp 400 can be fixed to playing field 218, thus magnet 402 would not be required.

As previously mentioned, the simulated soccer game of the present invention includes impediments through which the projectile must navigate to reach goals 212. In one embodiment, the impediments are figurines formed or cast in the image of human athletes, which gives the game a human appearance to enhance the imagination of the participants and reduce the notion that the game is an unrealistic substitute for the live game.

Figure 5:
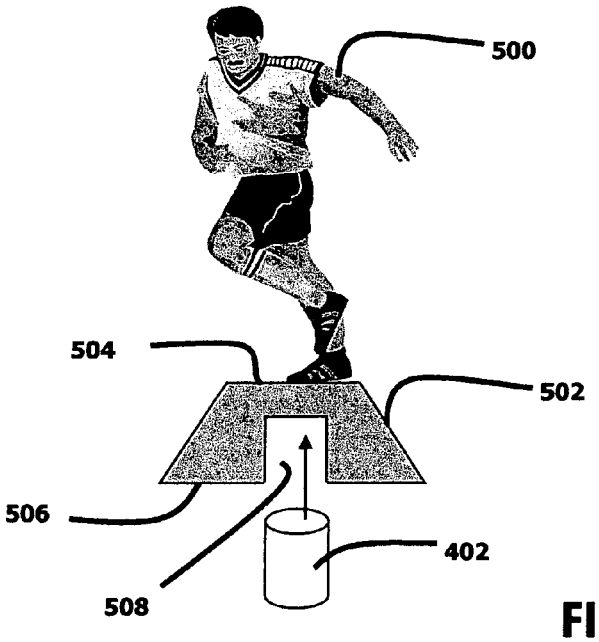
FIG. 5 is an illustration of a human image figurine in accordance with an embodiment of the present invention.
Figure 8A:
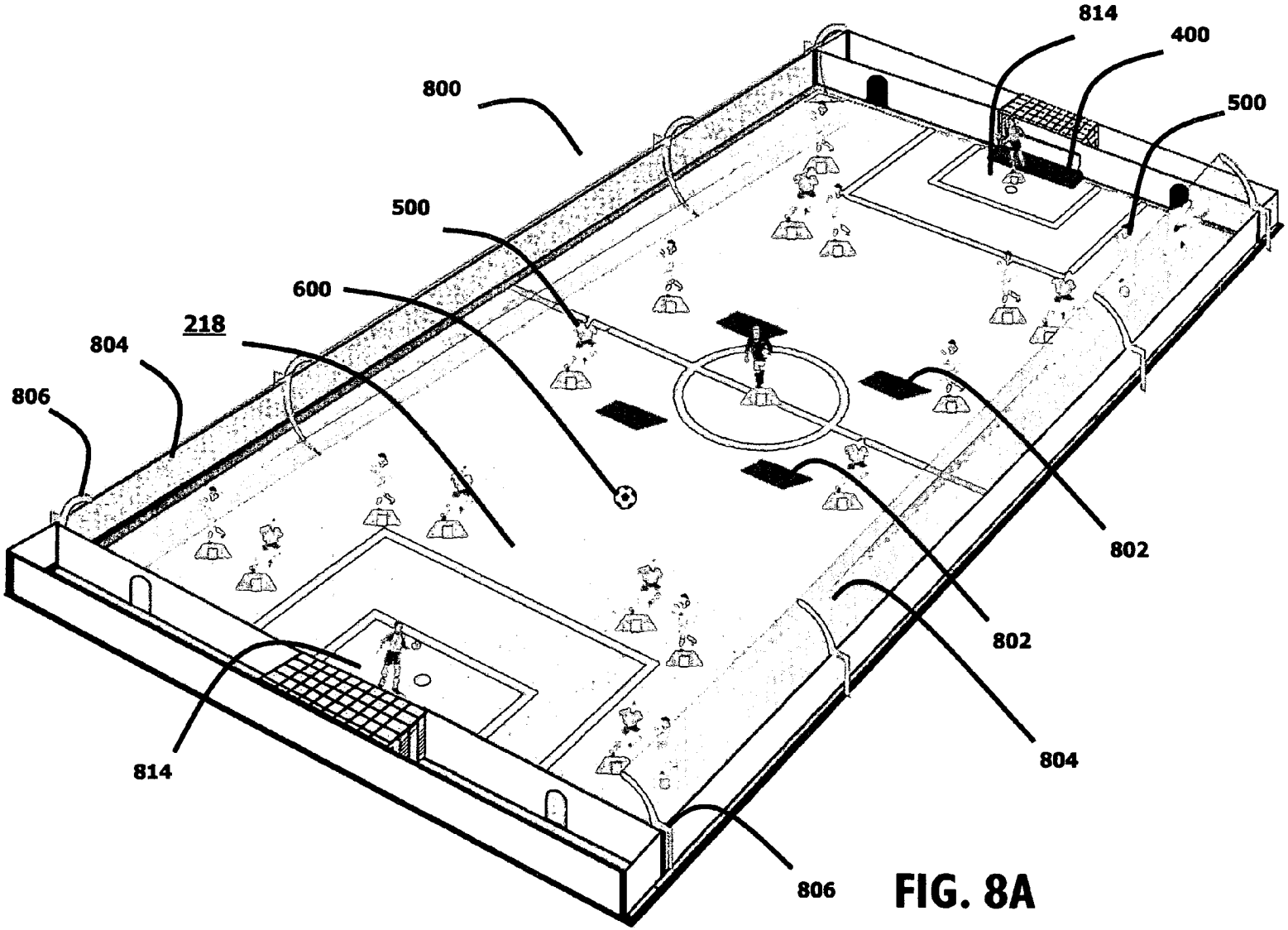
FIG. 8A is a simplified illustration of the game board with features randomly displayed in accordance with an embodiment of the present invention.

As shown in FIGS. 5 and 8A, each figurine 500 is positioned on a base 502. Base 502 can be made of any suitable dimensions. In one embodiment, base 502 is generally a trapezoid having a top surface 504 that is about ⅜ by ⅝ inches and a bottom surface 506 that is about ⅝ by ⅝ inches. Each figurine 500 is approximately 2 inches in height with the height of base 502 being approximately ½ inch.

Base 502 also defines a slot 508 into which can be inserted a magnet 402. Magnet 402 creates an attraction between figurine 500 and playing field 218 (FIG. 2B) such that figurine 500 maintains its upright position, in any desired placement or formation, on field cloth 300. The attraction, however, is weak enough to allow figurine 500 to be moved, or re-staged from its original placement, by impact from the projectile.

The plurality of figurines 500 can be marked with one of two team colors in equal amounts. Two figurines 500 are marked in two distinct colors to represent goal keepers and one figurine is marked to represent a referee. Each figurine 500 is placed on playing field 218 using the magnetic attraction method to maintain figurines 500 in an upright position. During play each player distributes his or her figurines on playing field 218 in a configuration which he or she believes presents the most difficulty for the opponent.

Figure 6:
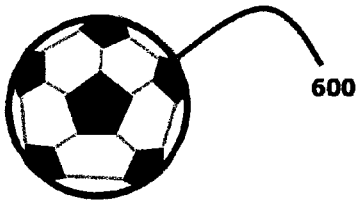
FIG. 6 is an illustration of a simulated soccer ball used to play the game and execute the scoring function in accordance with an embodiment of the present invention.

The projectile heretofore mentioned for use with the game can be any projectile that can be easily caused to move, especially by the urging of the human hand, around playing field 218. In one embodiment, the projectile is a simulated soccer ball 600 (FIG. 6), which is intended to roll and ricochet off of figurines 500 and surrounding walls, with the ability to elevate slightly via bias elevation ramps 400.

Soccer ball 600 is sized to fit through goals 212, as well as openings 226, while being sized to be effectively used during play. In one embodiment, soccer ball 600 can be approximately ⅝ inches in diameter. Soccer ball 600 can be made of a polymer material or, alternatively, soccer ball 600 can be a glass sphere.

Movement of the ball throughout the game is effected with the player's hand, specifically the player's finger(s), which simulate the action of a life sized player's legs and feet. Players take turns "flicking" soccer ball 600 with a finger of the hand in order to aim around figurines 500 and other obstructions present on playing field 218 to eventually move ball 600 through elevation ramp 400 at the lip of the opposing side's goal. When the ball passes the lip of a goal, the player opposite to the goal scores a point, even if a player passes the ball through their own goal.

Figure 7:
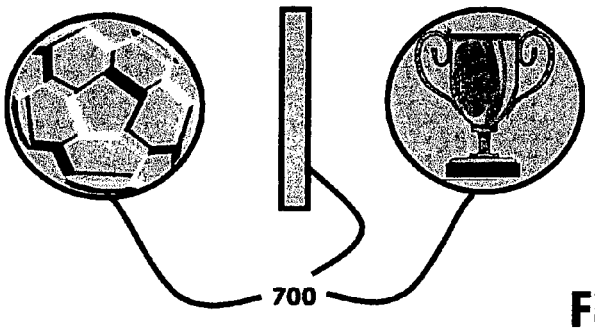
FIG. 7 is an illustration of a two sided coin that is used to determine which participant initiates the game in accordance with an embodiment of the present invention.

In one embodiment, as shown in FIG. 7, a game coin 700 is provided, which is a thin cylindrical shaped double sided polymer object, resembling a monetary coin which has two different images, one on either side. A flip of the coin is used to aid in determining which of the two participants initiates the game.

In one embodiment, popular team names along with score cards are printed on white glossy card stock, cut to a defined size to be selected and placed on the inner side of the game board's neutral zone, which may be displayed for the entire duration of each game.

FIG. 8A is an illustration of an embodiment of the fully bordered mini sphere futbol soccer board game embodying the principles and concepts of the present invention and generally designated by the reference numeral 800.

In one embodiment, a plurality of bias elevation ramps 802 can be randomly placed on playing field 218 to provide an increased level of difficulty and added realism as soccer ball 600 is made to elevate over the field. Each bias elevation ramp 802 is placed on playing field 218 in order to provide additional obstacles. Before play begins, each player distributes his or her bias elevation ramps 802 on playing field 218 in a configuration which he or she believes presents the most difficulty for the opponent.

In one embodiment, a plurality of insertable barriers 804 are provided, which couple to vertical walls 220 via a connector 806.

Figure 8B:
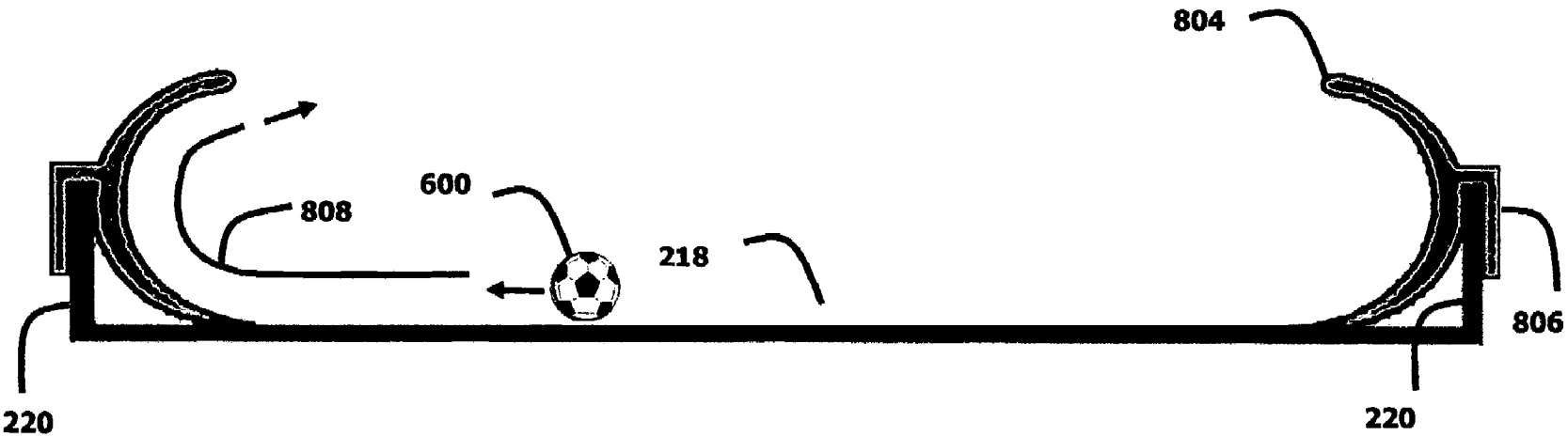
FIG. 8B is a simplified side view of an insertable barrier used with the game board in accordance with an embodiment of the present invention.

As shown in FIG. 8B, barriers 804 can be used to alter the reaction of soccer ball 600 to the edge of the playing area and allow for an additional barrier on the field for advanced play. For example, as soccer ball 600 reaches an edge of playing field 218 ball 600 engages barrier 804 and is biased back onto the playing field as indicated by arrow 808. The insertable barriers 804 may be added to the long and short edges of playing field 218. Barriers 804 are coupled to side walls 220 and insets 222 using a connector 806 which is formed with barrier 804 or else attached thereto, and which overhangs the side walls.

Barriers 804 are made of a clear plastic or similar material so that a view of the game and of the sponsor's logos and names is not obstructed.

Barriers 804 may be inserted prior to the commencement of the game at the discretion of the players to adapt the shape of the board and allow for more complicated ball trajectories during play.

This game may be played with two or more participants, upon (if there are more than two) a pre-agreed order of sequential participation. Once the sealed compact board is opened, and placed on any horizontal surface, the participants must choose one of the team selection cards, to decide which team or country they represent.

The game set up begins by manual and random placement, of all 23 non-restricted figurines 500. In one embodiment, a minimum length equal to that of base 502 should be maintained between each other base 502 of figurines 500 during the initial placement to conserve a minimum distance to allow for the passage of soccer ball 600. The participants take turns placing a single figurine 500 on playing field 218.

The impact of soccer ball 600 against figurines 500 may cause them to be moved closer or further from other figurines. Since this type of movement is encouraged as a strategy to winning the game, figurines 500 are not to be manually re-staged to their original locations during play. This allows the opportunity for intentional and unintentional position changes, creating risks for or against each player.

The goal keeper figurine can be manually re-staged after each goal is scored, or before a penalty shot. However, the goal keeper figurine cannot be placed outside of its designated inner area 814.

Once figurines 500 and bias elevation ramps 802 have been randomly staged, the players determine who initiates play by having one player call out one of the two sides of the game coin surface, while the coin is flipped in the air. The challenger that selected the upward visible side initiates the game.

Participants then take sequential turns, trying to project soccer ball 600 using a finger into the opposing team's goal post inner perimeter, thus scoring a goal point.

A foul is committed when a participant strikes any figurine 500 with any part of the hand or body, or when a figurine 500 is tipped over by the impact from soccer ball 600.

When a foul is committed, the participant whom the foul was committed against retains the right to manually place the game sphere, on either of the opposing player's outer corner areas by the outer boundary lines, and attempt to direct soccer ball 600 towards the goal post's inner perimeter.

A free corner shot from position 302 (FIG. 3A) is allowed when the participant projecting soccer ball 600 causes the ball to pass through opening 226 into space 224.

A second shot is awarded if a participant touches the opposing team's goal post without scoring a goal.

A free penalty shot, from the penalty spot, inside the large area directly in front of goals 212, is allowed against the participant who has urged soccer ball 600 to stop completely inside the center perimeter boundary circle, outlined in the middle, of the entire game board. If the free penalty shot is missed, the game resumes, with the defensive participant projecting the ball.

The game ends when one participant scores the total amount of goals agreed upon prior to the game.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A board for simulation of the game of futbol soccer comprising, in combination:

a game board defining long edges and short edges and having a planar surface with vertically raised walls and two holes targeted at the center of said short edges to effect a goal opening such that the goals face each other at opposing ends of the game board, and four smaller holes in the short edges of the board to effect additional targets, said game board covered with a cover;

a plurality of biasing elevation ramps having magnets to temporarily secure the biasing elevation ramps upon the surface of the game board which retain mobility during play;

a plurality of free-standing figurines, each mounted upon a base having magnets to temporarily secure the figurines in a standing position to the game board while retaining mobility during play, wherein the free-standing figurines are moveably coupled to the game board by a magnetic force; and curved barriers which alter the shape of the vertically raised walls to allow for additional trajectory elevation of a game ball during play.

2. The board of claim 1, further comprising an enclosure in which the game board may be disposed for carrying and storage, wherein said enclosure has walls shaped to fit with the game board.

3. The board of claim 1, wherein the cover comprises a ferromagnetic material on which the biasing elevation ramps and plurality of figurines are mounted while retaining mobility.

4. The board of claim 3, wherein each of said plurality of figurines comprises a color associated with a generic team, a local team or a national futbol soccer team.

5. The game board of claim 1, wherein said barriers are coupled to said vertically raised walls using an overlapping connector.

6. The board of claim 1, further comprising a metallic mesh disposed between said cover and said game board to create an attraction to said magnets.

7. The board of claim 6, wherein a ball traversing said cover can be struck with a player's finger to effect movement throughout the game board.

8. The board of claim 1, wherein said cover comprises standard futbol soccer markings.

9. A soccer game apparatus comprising, in combination, a planar support surface, the support surface including a playing field, the playing field including a perimeter wall member fixedly and orthogonally mourned to the planar support surface in alignment with an outer perimeter of the playing field;

a plurality of free-standing figurines having a human image and each including a magnet, said figurines positionable on said top surface of said playing field in various patterns about the field of play, said figurines moveable from a first position to a second position during play from having contact with a game sphere, wherein the free-standing figurines are moveably coupled to the playing field by a magnetic force;

a plurality of biasing elevation ramps having magnets to temporarily secure the biasing elevation ramps upon the surface of the playing field which retain mobility during play: and barriers which alter the shape of the perimeter wall member of the playing field and allow for additional trajectory elevation of a game ball during play.

10. The apparatus of claim 9, further comprising an enclosure in which the game board may be carried and stored, the walls of said enclosure shaped to fit with the planar support surface.

11. The apparatus of claim 9, wherein each of said plurality of figurines comprises colors associated with a generic team, a local team or national futbol soccer team.

12. The apparatus of claim 9, wherein said barriers are coupled to said perimeter wall member using an overlapping connector.

13. The apparatus of claim 9, wherein said playing field comprises a cover overlaying a metallic mesh disposed between said cover and said planar support surface to create an attraction between said playing field and said magnets.

14. The apparatus of claim 13, wherein a game ball is struck with a player's finger to effect movement of the game ball over said cover.

15. A board for simulation of the game of futbol soccer comprising, in combination:

a game board defining long edges and short edges and having a planar surface with vertically raised walls and two holes targeted at the center of said short edges to define a goal opening such that the goals face each other at opposing ends of the game board, said game board covered with a cover;

a plurality of biasing elevation ramps having magnets to temporarily secure the biasing elevation ramps upon the surface of the game board which retain mobility during play;

a plurality of free-standing figurines, mounted upon a base having magnets to temporarily secure the figurines in a standing position to the game board while retaining mobility during play, wherein the free-standing figurines are moveably coupled to the game board by a magnetic force; and curved barriers which alter the shape of the vertically raised walls to allow for additional trajectory elevation of the game ball during play.

16. The board of claim 15, wherein said cover comprises a ferromagnetic material on which the biasing elements and plurality of figurines are mounted while retaining mobility.

17. The board of claim 15, further comprising a metallic mesh disposed between said cover and said game board to create an attraction to said magnets.

18. The board of claim 15, further comprising an enclosure in which the game board may be disposed for carrying and storage, the walls of said enclosure shaped to fit with the game board.

* * * * *